US005971687A

United States Patent [19]

Ito et al.

[11] Patent Number: 5,971,687

[45] Date of Patent: Oct. 26, 1999

[54] FUEL PUMP AND METHOD OF MANUFACTURING THE SAME

[75] Inventors: Motoya Ito, Hekinan; Takeshi Matsuda, Anjo, both of Japan

[73] Assignee: Denso Corporation, Kariya, Japan

[21] Appl. No.: 08/841,596

[22] Filed: Apr. 30, 1997

[30] Foreign Application Priority Data

May 21, 1996 [JP] Japan ..... 8-126064

[51] Int. Cl.[6] ..... F04B 35/04

[52] U.S. Cl. ..... 411/238; 417/423.7

[58] Field of Search ..... 417/423.3, 427.7, 417/423.14, 238; 310/154, 89, 191

[56] References Cited

U.S. PATENT DOCUMENTS 5,391,062 2/1995 Yoshioka ..... 417/423.14

5,401,147 3/1995 Yu ..... 417/423.14

5,455,473 10/1995 Lipo et al. ..... 310/114

FOREIGN PATENT DOCUMENTS 3-129793 12/1991 Japan .

*Primary Examiner*—Charles G. Freay

*Attorney, Agent, or Firm*—Nixon & Vanderhye P.C.

[57] ABSTRACT

A fuel pump is composed of a permanent-magnet motor section and a pump section. The yoke of the motor section is designed as a part of the magnetic circuit which is saturated with magnetic flux. The quantity of the discharged fuel is adjusted by covering from outside an auxiliary yoke which is changeable according to a difference between the actual quantity of the discharged fuel and a required quantity of the fuel.

13 Claims, 6 Drawing Sheets

FUEL PUMP AND METHOD OF MANUFACTURING THE SAME

BACKGROUND OF THE INVENTION

1. Field of the Invention

The present invention relates to a fuel pump and a method of manufacturing the fuel pump.

2. Description of the Related Art

Recently, an electromagnetic fuel pump for vehicles which is composed of a motor section and pump section is widely used. In general, such a fuel pump is designed to discharge a fixed quantity of fuel more than the quantity required by an engine. Reduction in the electric power consumed by the fuel pump is effective to suppress fuel consumption, and reduction in electric load of an alternator is an important subject of conserving limited resources and protecting the global environment.

Because the motor section and the pump section are composed of various parts and components having variety in sizes and performance, the fuel pump must be designed to discharge a quantity of fuel required for the engine taking such variation into account. As a result, such a pump is apt to discharge more quantity of fuel than required by the engine, thereby wasting electric power. In a fuel pump system which has a fuel-return passage, as the returned fuel quantity increases temperature of the fuel in the fuel tank rises, thereby generating fuel vapor.

JPU-3-129793 proposes a fuel pump which has a magnetic movable member disposed inside the yoke between adjacent permanent magnets. Such a movable member is moved from the outside by an adjusting screw to change the magnetic resistance between two permanent magnets, thereby changing the rotation speed of the motor and the resultant fuel quantity.

However, such a conventional fuel pump needs an additional member for sealing the movable member and the adjusting screw connected to the movable member, resulting in increase in production steps and cost.

SUMMARY OF THE INVENTION

The present invention is made in order to solve the above stated problem and is to provide a discharge-quantity-adjustable fuel pump and a method of manufacturing the same.

According to the present invention, a simple step of fixing an auxiliary yoke to a base yoke from the outside increases effective magnetic flux, thereby decreasing discharged fuel quantity to a required fuel quantity and power consumption of the fuel pump without any additional part.

Preferably, the discharged fuel is adjusted by changing thickness of the auxiliary yoke.

The auxiliary yoke can be formed simply from a magnetic plate member by press-forming.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENTS

First Embodiment

Figure 1:
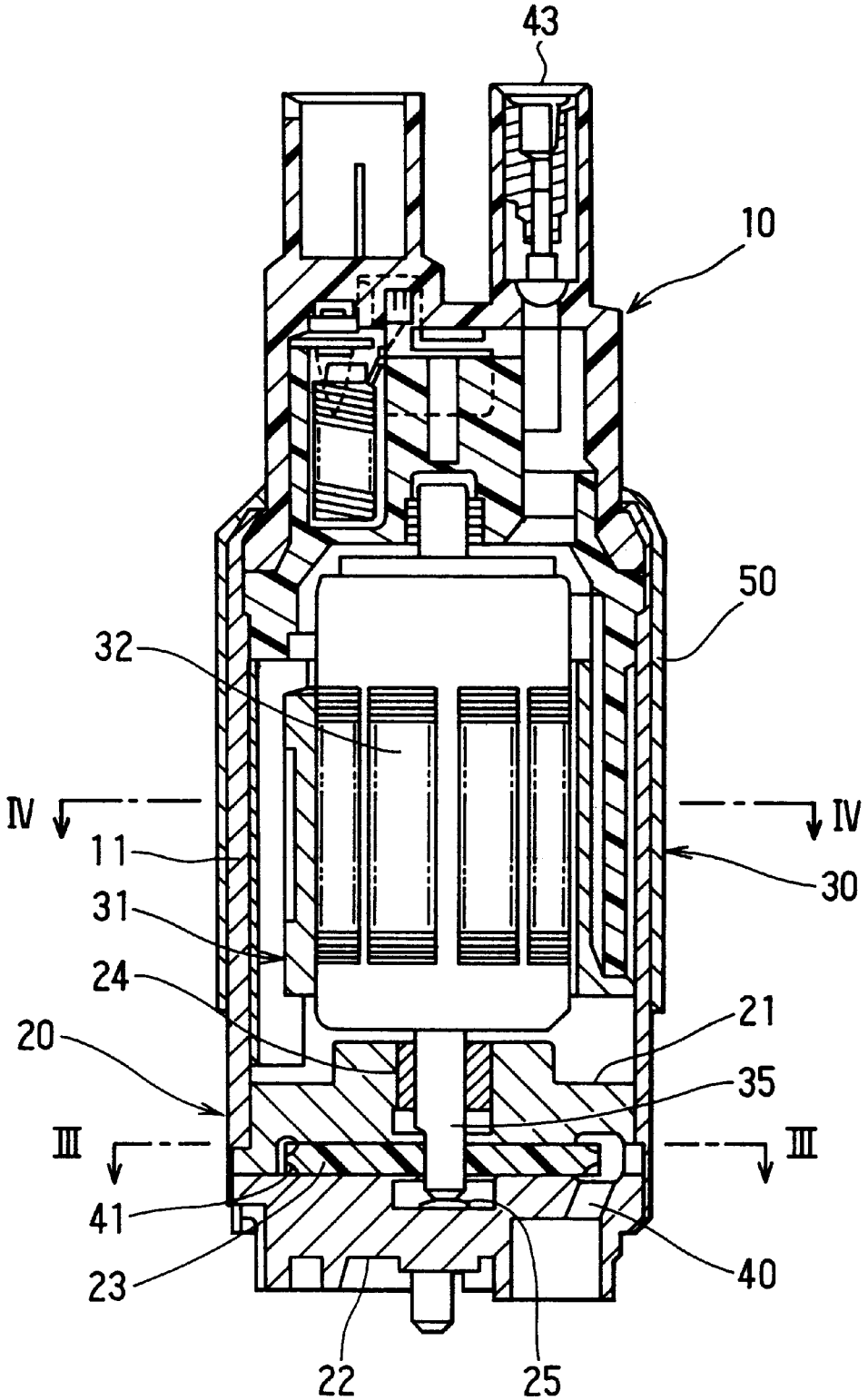
FIG. 1 is a cross-sectional view illustrating a fuel pump according to a first embodiment of the present invention.

A first embodiment is described with reference to FIGS. 1 to 4. As shown in FIG. 2, a fuel supply system 2 is composed of a fuel pump 10 disposed in a fuel tank 3, a pressure regulator 4 for regulating the pressure of fuel discharged by the fuel pump 10, injectors 5 for injecting fuel into cylinders of an engine 1 and fuel pipes connecting the above parts and components. The fuel pump 10 is powered by a vehicle battery (not shown) to suck fuel through a filter 7 and to supply the fuel to a fuel delivery pipe 8. On the other hand, surplus fuel is discharged from the fuel regulator 4 and returned to the fuel tank through a fuel return pipe 9.

Figure 2:
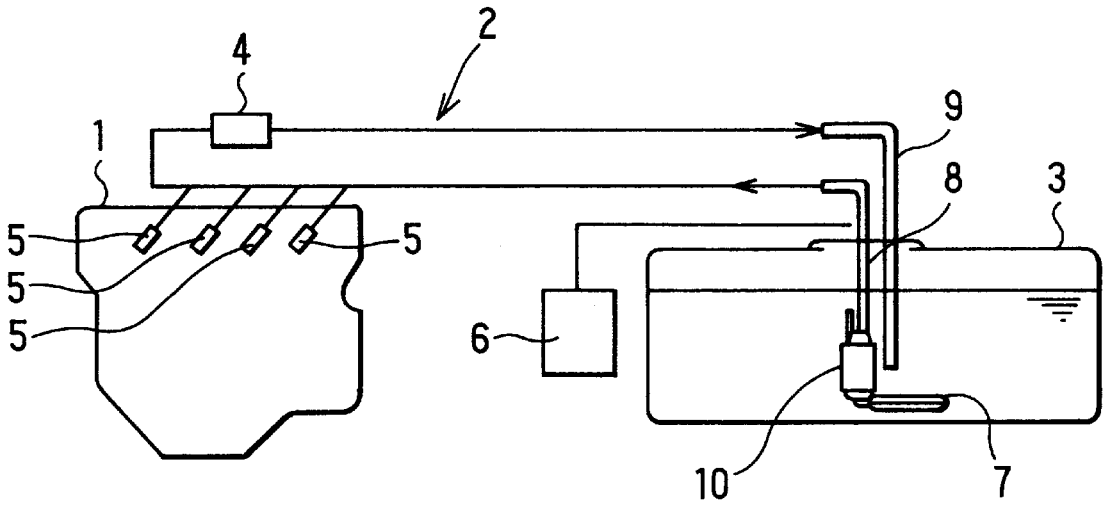
FIG. 2 is a schematic diagram illustrating a fuel supply system including the fuel pump according to the first embodiment.

As shown in FIG. 1, the fuel pump 10 is composed of a pump section 20 and a motor section 30 for driving the pump section 20. The motor section 30 is composed of a DC motor which has a base cylindrical yoke 11, an annular permanent magnet unit 31 disposed inside the yoke and an armature 32 disposed inside the permanent magnet unit 31 coaxially therewith.

The pump section 20 is composed of a flange 21, a cover 22 and an impeller 23. The flange 21 and cover 22 are made of aluminum die-cast. The flange 21 is press-fitted to an end portion of the yoke 11 and is provided with a bearing 24 at the center thereof to support a shaft 35 of the armature 32. The flange 21 has an outlet 42 (shown in FIG. 3), through which fuel is discharged from the pump section 20 into the inside of the motor section 30. The cover 22 covers the flange 21 and is fitted to the same end of the yoke 11 by caulking or the like. The cover 22 has a thrust bearing 25 fixed at the center thereof to support the shaft 35 in the axial direction. The cover 22 has an inlet 40, through which fuel in the fuel tank 3 is sucked by the pump 20. The flange 21 and cover 22 form a casing for the pump section to accommodate the impeller 23 rotatably therein.

Figure 3:
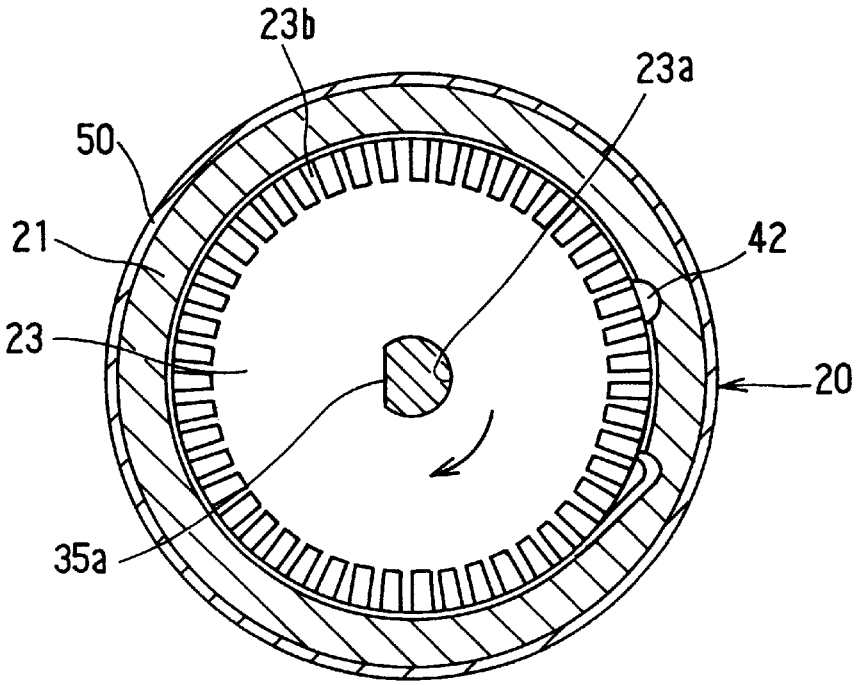
FIG. 3 is a cross-sectional view of the fuel pump cut along a line III—III in FIG. 1.

As shown in FIG. 3, the impeller 23 has a D-shaped opening 23*a* to receive a D-cut portion 35*a* of the shaft 35, so that the impeller 23 can rotate with the shaft and move in the axial direction slightly. The impeller 23 has a plurality of fan blades 23*b*, which suck fuel from the inlet 40 and discharge the fuel in the pump space 41 through the outlet 42 when rotated.

Figure 4:
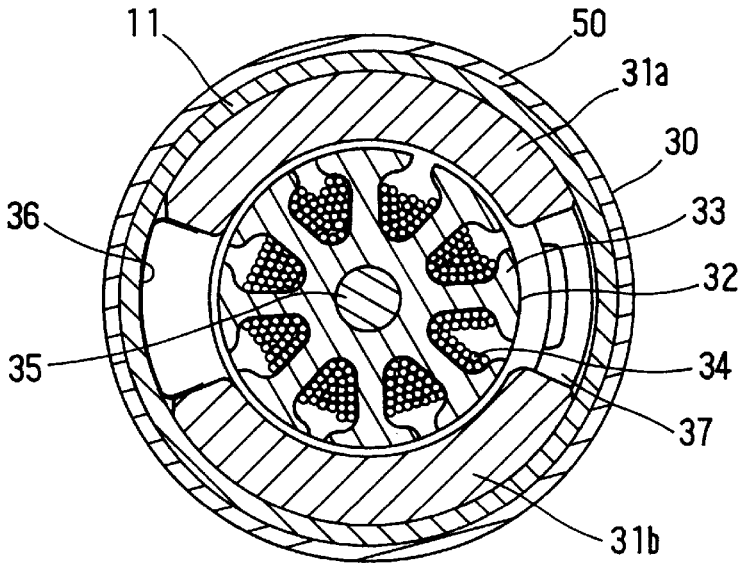
FIG. 4 is a cross-sectional view of the fuel pump cut along a line IV—IV in FIG. 1.

As shown in FIG. 4, permanent magnets 31*a* and 31*b* of the magnet unit 31 of the motor section 30 are magnetized to be N-poled and S-poled respectively, and a leaf spring 36 is disposed circumferentially between the permanent magnets 31*a* and 31*b*. The leaf spring 36 presses the permanent magnets 31*a* and 31*b* against a bearing holder 37 which is disposed at a portion between the permanent magnets opposite the leaf spring, thereby retaining the permanent magnets 31*a* and 31*b* in the yoke 11. The armature 32 is composed of a core 33 and coils 34 wound around the core 33 and disposed radially inside the permanent magnets 31*a* and 31*b*. A cylindrical auxiliary yoke 50 is press-fitted around the yoke 11. The auxiliary yoke 50 is made from a solid-drawn tube or a butt jointed tube of cylindrically-formed steel plate. The auxiliary yoke 50 forms a magnetic path together with the yoke 11. The upper portion of the auxiliary yoke 50 shown in FIG. 1 narrows to hold the yoke 11.

When the armature coils 34 of the armature 32 are energized, the armature 32 rotates with the shaft 35 and the impeller 23. Subsequently, fuel is sucked from the inlet 40 into the pump space 41 and discharged through spaces inside the motor section 30 from the inlet 42 into the inside of the motor. The fuel, after cooling the armature and other parts of the motor, is discharged from a fuel discharge port 43 to the injectors 5.

The quantity of the fuel discharged by the fuel pump 10 is decided by the rotation speed of the pump which is proportional to the terminal voltage of the battery 6 and the pressure of the pressure regulator 4 which is applied to the pump. The fuel pressure is approximately constant when the pump 10 is mounted on a vehicle. The rotation speed N of the DC motor is expressed by voltage E, effective magnetic flux $\phi$ and number of conductors Z as follows.

$$N=E/(\phi \cdot Z) \quad (1)$$

Figure 5:
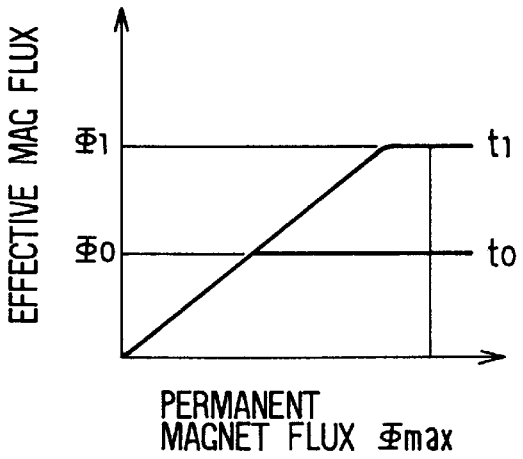
FIG. 5 is a graph showing relationship between magnetic flux of a permanent magnet and effective magnetic flux.
Figure 6:
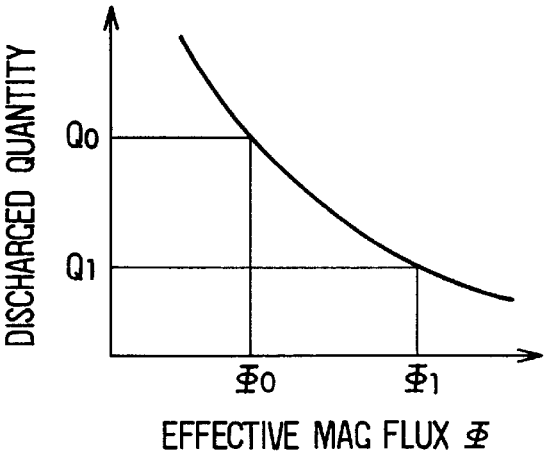
FIG. 6 is a graph showing relationship between the effective magnetic flux and quantity of discharged fuel.

That is, if the voltage E and number of conductors Z are constant, the rotation speed N decreases as the effective magnetic flux $\phi$ increases, and rotation speed N increases as the effective magnetic flux $\phi$ decreases. As shown in FIG. 5, if the magnetic flux of the permanent magnets increases, the effective magnetic flux also increases, and the rotation speed of the motor decreases thereby decreasing the fuel quantity as shown in FIG. 6.

It is difficult to change the permanent magnets after they are installed, and therefore the effective magnetic flux is adjusted by steps described hereafter. Incidentally, the characteristic curves shown in FIGS. 5, 6, 7 and 8 are exaggerated to show ideas for manufacturing a fuel pump.

Figure 7:
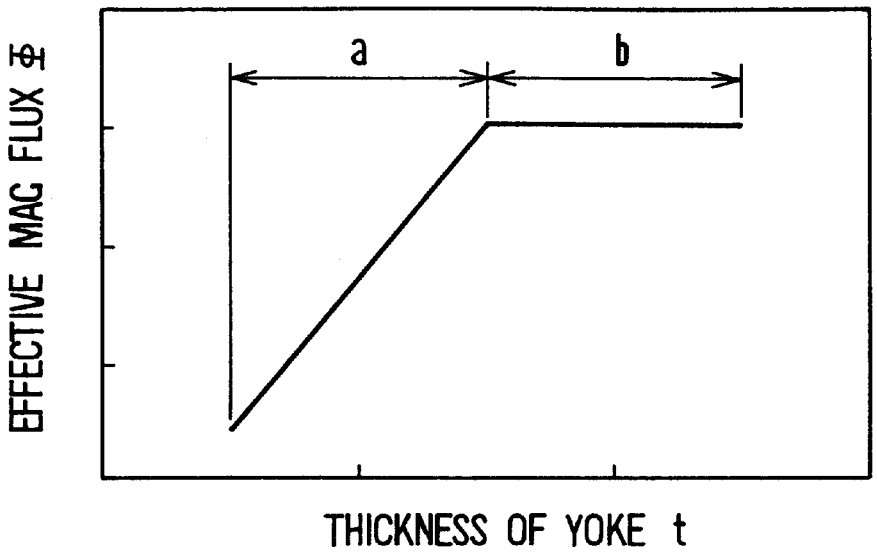
FIG. 7 is a graph showing relationship between thickness of a yoke and the effective magnetic flux.

The thickness of the yoke 11 is designed so that the magnetic circuit of the motor section 30 without the auxiliary yoke 50 becomes saturated at the yoke 11 as a portion b in FIG. 7.

The quantity of the fuel discharged by the fuel pump 10 in a unit time (hereinafter referred to as quantity) is designed to be more than the quantity required by the engine and variations in the quantity of respective fuel pumps. That is, all of the fuel pumps without the auxiliary yoke 50 are designed to discharge a greater quantity of fuel than the quantity required by the engine.

The quantity of fuel discharged by the fuel pump 10 is measured without the auxiliary yoke 50 to detect a difference between the actual quantity and the required quantity.

Figure 8:
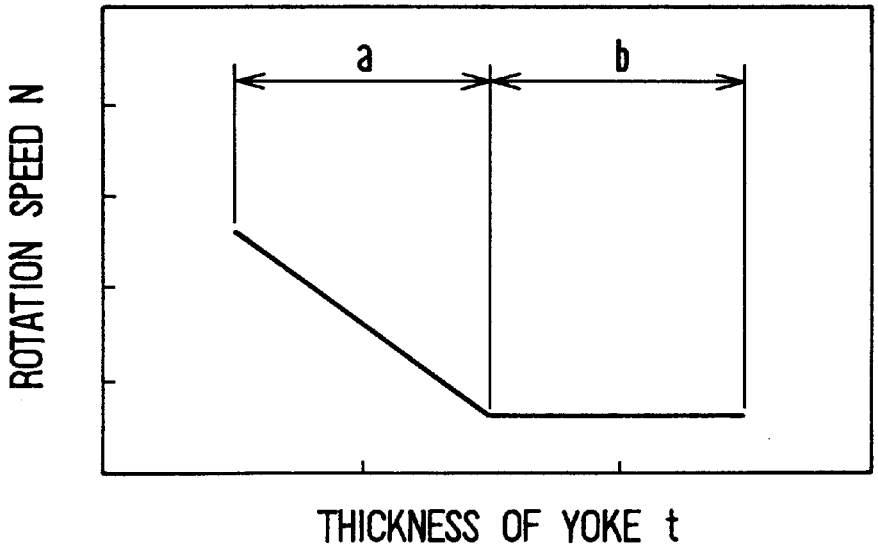
FIG. 8 is a graph showing relationship between thickness of the yoke and rotation speed of the motor.

The auxiliary yoke 50 is, thereafter, fixed around the yoke 11. An auxiliary yoke 50 having suitable thickness, which corresponds to the difference between the actual quantity and the required quantity, is selected and fitted around the yoke 11. The increase in the thickness increases the effective magnetic flux $\phi$ as shown in FIGS. 7 and decreases the rotation speed N of the motor section as shown in FIG. 8. The increase of the effective magnetic flux decreases the discharged quantity of fuel as shown in FIG. 6.

A test result of one of the above manufactured fuel pump is described hereafter.

The specification of the tested fuel pump is as follows:

the nominal discharge quantity is 85 L/h;

the external diameter is 38 mm;

the yoke is 1.6 mm thick;

the motor has eight slots;

the pump type is a regenerative (Wetsco) type;

the actual discharge quantity of the fuel pump without the auxiliary yoke is 94 L/h; and the driving current is 4.8 A.

A test result shows that an addition of the auxiliary yoke having thickness 1.0 mm decreases the discharge rate to 86 L/h (nearly equal to the required level) and decreases the driving current to 4.6 A.

Thus, the power consumption of the fuel pump is decreased, and surplus fuel is not returned to the fuel tank very much, suppressing generation of fuel vapor in the fuel tank 3.

Second Embodiment

Figure 9:
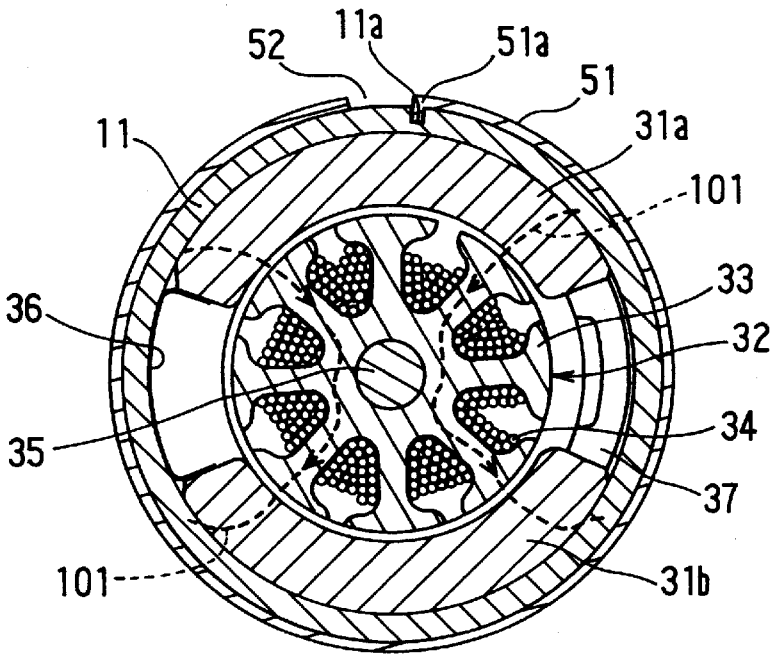
FIG. 9 is a cross-sectional view of a fuel pump according to a second embodiment.

A second embodiment is described with reference to FIG. 9, in which the same or substantially the same portion is indicated by the same reference numeral.

A cylindrical auxiliary yoke 51 is formed from a steel plate to provide with a longitudinally extending slit 52 and a ridge 51*a*, which is formed along one side facing the slit 52. A groove 11*a* is formed on the yoke, and the ridge 51*a* fits in the groove 11*a* so that the auxiliary yoke 51 is retained in both axial and circumferential directions. The slit 52 is located at the circumferential center of the N-poled permanent magnet 31*a*. Because the line of the magnetic force flows as indicated by a broken line 101, the slit 52 does not affect the magnetic flux. The slit 52 can be located at the S-poled permanent magnet or at more than a quarter of arc-length of said permanent magnet inside opposite ends of the permanent magnet.

Since the auxiliary yoke 51 is formed from a steel plate by press-forming, the production cost can be reduced.

Third Embodiment

Figure 10:
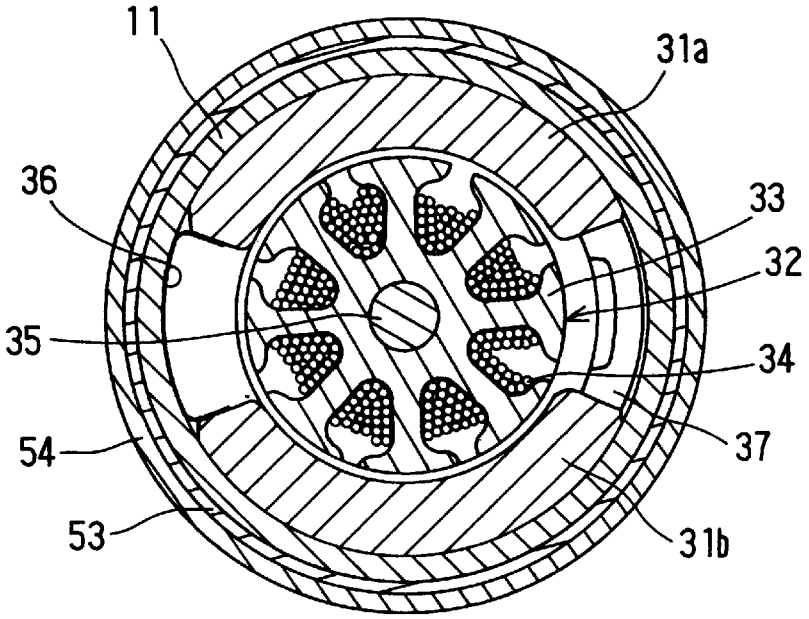
FIG. 10 is a cross-sectional view of a fuel pump according to a third embodiment.

A third embodiment is described with reference to FIG. 10, in which the same or substantially the same portion is indicated by the same reference numeral.

In the third embodiment, two or more auxiliary yokes 53 and 54 are put on top of one another to cover the yoke 11 in close contact therewith. Therefore, the total thickness of the base yoke and auxiliary yokes can be adjusted by various combinations of auxiliary yokes having different thickness so that the discharged fuel can be adjusted precisely. If thin auxiliary yokes are used, the total thickness can be adjusted without providing a variety of auxiliary yokes having different thickness, thereby reducing the production cost.

Fourth Embodiment

Figure 11:
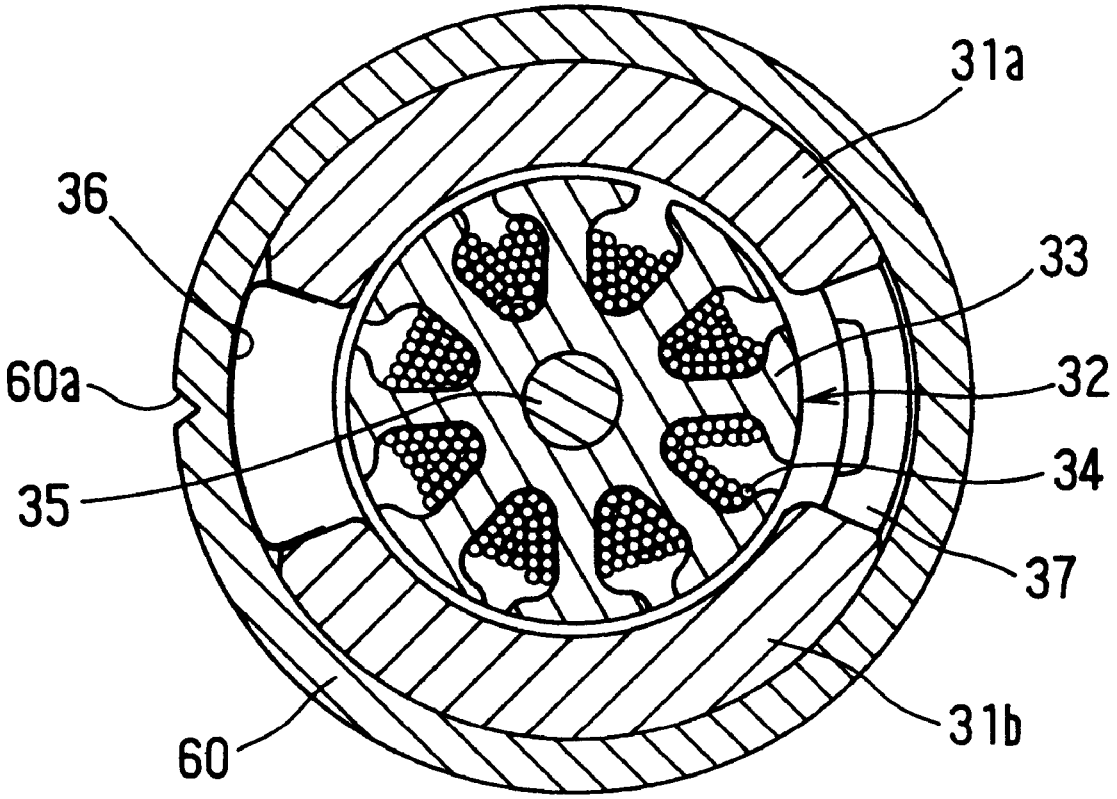
FIG. 11 is cross-sectional view of a fuel pump according to a fourth embodiment.

A fourth embodiment is described with reference to FIG. 11, where the same or substantially the same portion is indicated by the same reference numeral.

Different from the previous embodiments, a base yoke 60 has sufficient thickness not to be saturated with the magnetic flux.

After measuring the discharged fuel, a groove 60*a* is cut on a peripheral portion of the yoke between the two permanent magnets to adjust the effective magnetic flux so that the quantity of the discharged fuel increases to the required quantity.

The groove 60*a* can be formed over entire length of the yoke, or a plurality of grooves can be formed.

In the above embodiments, a plurality of arc-shaped magnetic members can be fixed to the base yoke or another auxiliary yoke by welding or soldering.

A plurality of short magnetic cylinders can be fixed side by side to the base yoke by welding or soldering. The short magnetic cylinders enhance accuracy of the inside diameters, ensuring close contact with the base yoke and resultant accuracy of the discharged fuel quantity.

According to the present invention, a groove can be formed on the auxiliary yoke to adjust the effective magnetic flux finely.

In the foregoing description of the present invention, the invention has been disclosed with reference to specific embodiments thereof. It will, however, be evident that various modifications and changes may be made to the specific embodiments of the present invention without departing from the broader spirit and scope of the invention as set forth in the appended claims. Accordingly, the description of the present invention in this document is to be regarded in an illustrative, rather than restrictive, sense.

What is claimed is:

1. A fuel pump comprising:

a motor section having a cylindrical base yoke and a pair of arc-shaped permanent magnets disposed on an inner periphery of said base yoke and an armature having a shaft and disposed inside said permanent magnets coaxially therewith;

a pump section having a flange and a cover fixed to an end of said base yoke, an impeller carried by said shaft and disposed between said flange and cover; and means including a magnetic member disposed around said base yoke, for changing effective magnetic flux thereby adjusting discharged quantity of fuel;

wherein:

said magnetic member comprises a cylindrical member fitted around said base yoke;

said cylindrical member has a slit and a ridge;

said base yoke has a groove for receiving said ridge for holding said cylindrical member; and said slit is located at more than a quarter of arc-length of said permanent magnet inside opposite ends of said permanent magnet.

2. A fuel pump comprising:

a motor section having a cylindrical base yoke and a pair of arc-shaped permanent magnets disposed on an inner periphery of said base yoke and an armature having a shaft and disposed inside said permanent magnets coaxially therewith;

a pump section having a flange and a cover fixed to an end of said base yoke, an impeller carried by said shaft and disposed between said flange and cover; and means including a magnetic member disposed around said base yoke, for changing effective magnetic flux thereby adjusting discharged quantity of fuel;

wherein said magnetic member comprises a plurality of cylindrical plates disposed around said base yoke.

3. A fuel pump comprising:

a motor section having a cylindrical base yoke and a pair of arc-shaped permanent magnets disposed on an inner periphery of said base yoke and an armature having a shaft and disposed inside said permanent magnets coaxially therewith;

a pump section having a flange and a cover fixed to an end of said base yoke, an impeller carried by said shaft and disposed between said flange and cover; and means, disposed around said base yoke, for changing effective magnetic flux thereby adjusting discharged quantity of fuel;

wherein said means comprises a portion of said base yoke having a groove to decrease effective magnetic flux.

4. A method of manufacturing a fuel pump having a permanent-magnet-motor, said method comprising steps of:

preparing a motor section having a permanent magnet and a base yoke for providing a magnetic path saturated with magnetic flux of said permanent magnet;

measuring the quantity of fuel discharged by said fuel pump to detect the difference between said measured quantity and a desired quantity; and fixing a magnetic member to said base yoke according to said difference, thereby adjusting the quantity discharged by said pump to said desired quantity.

5. The method of manufacturing a fuel pump as claimed in claim 4, wherein said fixing step comprises steps of:

preparing a variety of cylindrical magnetic members having different thickness, and selecting one of said cylindrical magnetic members according to said difference.

6. The method of manufacturing a fuel pump as claimed in claim 4, wherein said magnetic member comprises a plurality of cylindrical magnetic members, and said plurality of cylindrical magnetic members are fixed to said base yoke to adjust said quantity of discharged fuel.

7. The method of manufacturing a fuel pump as claimed in claim 5, wherein each of said plurality of cylindrical magnetic members has a longitudinally extending slit.

8. The method of manufacturing a fuel pump as claimed in claim 7, wherein said plurality of cylindrical magnetic members are fixed so that said slit is located at more than a quarter of arc-length of said permanent magnet inside opposite ends of said permanent magnet.

9. A power-customized fuel pump comprising:

a basic permanent magnet motor section having a rotor and a stator with an outer magnetic circuit connecting return magnetic flux between a plurality of permanent magnets associated with the stator and thus providing a basic determined motor speed N for a predetermined basic consumption of electrical power E and basic effective magnetic flux $\Phi$ where $N \approx E/\Phi$;

an integral fuel pump section having a rotary pump connected to be driven by the rotor of said motor; and an additional predetermined power customizing structure mechanically affixed to said outer magnetic circuit thereby to change the motor speed N and consumption of electrical power E by changing the effective magnetic flux $\Phi$ to a customized predetermined value which, in turn, causes the motor speed N and consumed electrical power E to assume different predetermined customized values such that a given basic fuel pump is thus customized for use in a predetermined one of plural vehicular environments by customizing motor speed and/or consumed electrical power to desired more nearly optimum values for the predetermined one of the vehicular environments.

10. A power customized fuel pump as in claim 9 wherein said additional predetermined customizing structure comprises a magnetically permeable member immovably affixed to the exterior of the outer magnetic circuit of the stator.

11. A power customized fuel pump as in claim 9 wherein said additional predetermined structure comprises an at least partly cylindrical member immovably fitted around said basic permanent magnet motor.

12. A power customized fuel pump as in claim 10 wherein said additional predetermined customizing structure comprises a plurality of overlapping layers.

13. A power customized fuel pump as in claim 9 wherein said additional predetermined structure comprises at least one groove permanently formed into said outer magnetic circuit of the basic motor.

* * * * *